US006623371B2

(12) United States Patent
Corcoran

(10) Patent No.: US 6,623,371 B2
(45) Date of Patent: Sep. 23, 2003

(54) GOLF PUTTING AND BALL RETURN SYSTEM

(76) Inventor: Jerry A. Corcoran, 1586 N. Redwood St., Canby, OR (US) 97013

( * ) Notice: Subject to any disclaimer, the term of this patent is extended or adjusted under 35 U.S.C. 154(b) by 0 days.

(21) Appl. No.: 09/776,504

(22) Filed: Feb. 2, 2001

(65) Prior Publication Data

US 2002/0107079 A1 Aug. 8, 2002

(51) Int. Cl.[7] ..... A63B 69/36

(52) U.S. Cl. ..... 473/184; 473/166; 473/191; 473/194

(58) Field of Search ..... 473/163, 166, 473/182–184, 191, 194, 186, 109; 273/127 R, 127 C

(56) References Cited

U.S. PATENT DOCUMENTS

| | | | |
|---|---|---|---|
| D83,497 | S | 3/1931 | Carter |
| 1,856,816 | A | 5/1932 | Luddy |
| 2,110,925 | A | 3/1938 | Trangmar |
| 2,609,199 | A | 9/1952 | Koener |
| 3,365,199 | A | 1/1968 | Scholin et al. |
| 3,540,733 | A | 11/1970 | LaMattina |
| 3,801,107 | A | 4/1974 | Martin |
| 3,856,313 | A | 12/1974 | Tierney |
| 4,336,939 | A | 6/1982 | Krumlauf |
| 4,563,009 | A | 1/1986 | Nagasaki et al. |
| 5,102,141 | A | 4/1992 | Jordan |
| 5,242,169 | A | 9/1993 | Laabs et al. |
| 5,501,462 | A | 3/1996 | Shih |
| 5,595,543 | A | 1/1997 | Wolk |

*Primary Examiner*—Mark S. Graham
(74) *Attorney, Agent, or Firm*—Keith A. Cushing

(57) ABSTRACT

A golf putting training controls golf ball momentum into a delivery site by first absorbing momentum of indeterminate magnitude and thereafter allowing the ball to move along a controlled or sloped path under influence of gravity. As a result, the ball enjoys consistent momentum and alignment upon arrival at the delivery site. The delivery site can be a kick-back device operating more consistently when receiving a ball moving along a consistent approach path and with consistent momentum. The delivery site can also be a golf ball return area whereat a golf ball is desirably returned consistently to a given region thereof.

7 Claims, 9 Drawing Sheets

GOLF PUTTING AND BALL RETURN SYSTEM

BACKGROUND OF THE INVENTION

The present invention relates to sports-training devices and, more particularly, to a golf-training device for putting and including a ball return system.

Golfers practice both on the golf course and off the golf course to hone skills and improve scores. Golf training aids offer to the golfer an opportunity to practice golfing skills without actually going to a golf course or even leaving the home or office. Among the wide variety of such golf training aids, putting practice training devices are both notable and popular. Golfers can practice putting indoors on carpeting with a simulated target. While a simple target, e.g., an overturned glass or designated spot on the carpet, serves for a given single putt, the golfer typically putts multiple times at the target and desires that the ball consistently return to a given position from which a next putt may be executed. Furthermore, the golfer typically desires that the target simulate an actual golf cup or hole.

Thus, desirable putting practice training devices allow the golfer to target an actual hole and thereby simulate putting on a real golf course. Typically, these devices include a kick-back device propelling the golf ball back to the golfer whether the golfer hits the target or not, i.e., returns the ball to the golfer whether or not the golfer successfully drops the ball in the hole or cup.

U.S. Pat. No. 5,102,141 issued Apr. 7, 1992 to L. E. Jordan and entitled *GOLF PUTTING PRACTICE DEVICE* illustrates a golf-training device. The golfer putts a ball from one end of a flat area and across the flat area toward a slightly inclined ramp. The ball climbs the ramp and reaches a plateau including a target hole. An open and inclined capture trench lies laterally across and borders the back of the plateau behind the hole. Any ball going past the hole falls in the capture trench. The well or bottom of the hole couples by tunnel, i.e., under the surface of the plateau, to a mid-portion of the capture trench. Thus, any ball reaching the plateau either falls in the capture trench, i.e., when the golfer misses the putt, or falls in the hole and then reaches the capture trench by way of the tunnel. Because the return trench is inclined, the ball moves laterally therein. The trench terminates immediately adjacent to a kick-back device, i.e., a kick-back device located at the capture trench outlet. The kick-back device includes a trigger and plunger. When the ball hits the trigger, the kick-back device activates the plunger and the plunger strikes the ball to propel it longitudinally, i.e., back toward the golfer, along a return gutter. The return gutter terminates at a side-kick structure converting the longitudinal momentum of the ball into lateral momentum. More particularly, the ball strikes a rounded or diagonally oriented surface deflecting the ball from its longitudinal path along the gutter into and along a lateral path toward the flat area. The ball desirably comes to rest at the front of the flat area in position for a second putt toward the hole.

Unfortunately, such kick-back devices do not consistently propel the ball along its return path. In some cases, the ball simply does not properly engage the trigger and the device fails to activate the plunger. In other cases, the plunger does not consistently strike the ball and the kick-back device imparts inconsistent momentum along the return path. Because the longitudinal return momentum is inconsistent, when the side-kick structure converts it to lateral momentum the final resting place for the golf ball is indeterminate. In other words, the ball does not always return to the same spot in the putting area. Thus, when the ball does return to the flat area it typically comes to rest at substantially different locations from one putt to the next putt due to inconsistent delivery momentum along its return path.

It would be desirable to provide, therefore, a putting practice device more reliably and consistently returning the golf ball to the golfer. The subject matter of the present invention provides such a golf putting and ball return system.

SUMMARY OF THE INVENTION

The present invention controls golf ball momentum by first absorbing momentum of indeterminate magnitude and then allowing the golf ball to move under influence of gravity. In some cases, a controlled path directs the ball at key times to establish a consistent travel path.

A fundamental problem with prior art golf putting training aids is the lateral approach of the ball at the kick-back device. A lateral approach fails to consistently trigger the kick-back device or position the ball consistently for engagement by the plunger.

Under the present invention, however, the ball approaches the kick-back device longitudinally along a controlled path and under influence of gravity to consistently activate the trigger and to consistently position the ball for engagement by the plunger. As a result, the ball consistently activates the kick-back device and the kick-back device plunger imparts consistent momentum to the ball.

The invention also applies to ball return to the putting area whereby indeterminate magnitude longitudinal delivery momentum is absorbed and new and controlled lateral momentum returns the golf ball consistently to a given region of the putting area.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

The present invention controls momentum by first absorbing momentum of indeterminate magnitude and then allowing the golf ball to move under influence of gravity. In some cases, a controlled path directs the ball at key times to establish consistent movement. A fundamental problem with prior art golf putting training aids is the lateral approach of the ball toward the kick-back device. A lateral approach fails to consistently trigger the kick-back device or position the ball consistently for engagement by the plunger. Under the present invention, however, the ball approaches the kick-back device longitudinally along a controlled path and under influence of gravity to consistently activate the trigger and to consistently position the ball for engagement by the plunger. As a result, the ball consistently activates the kick-back device and the kickback device plunger imparts consistent momentum to the ball.

Figure 1:
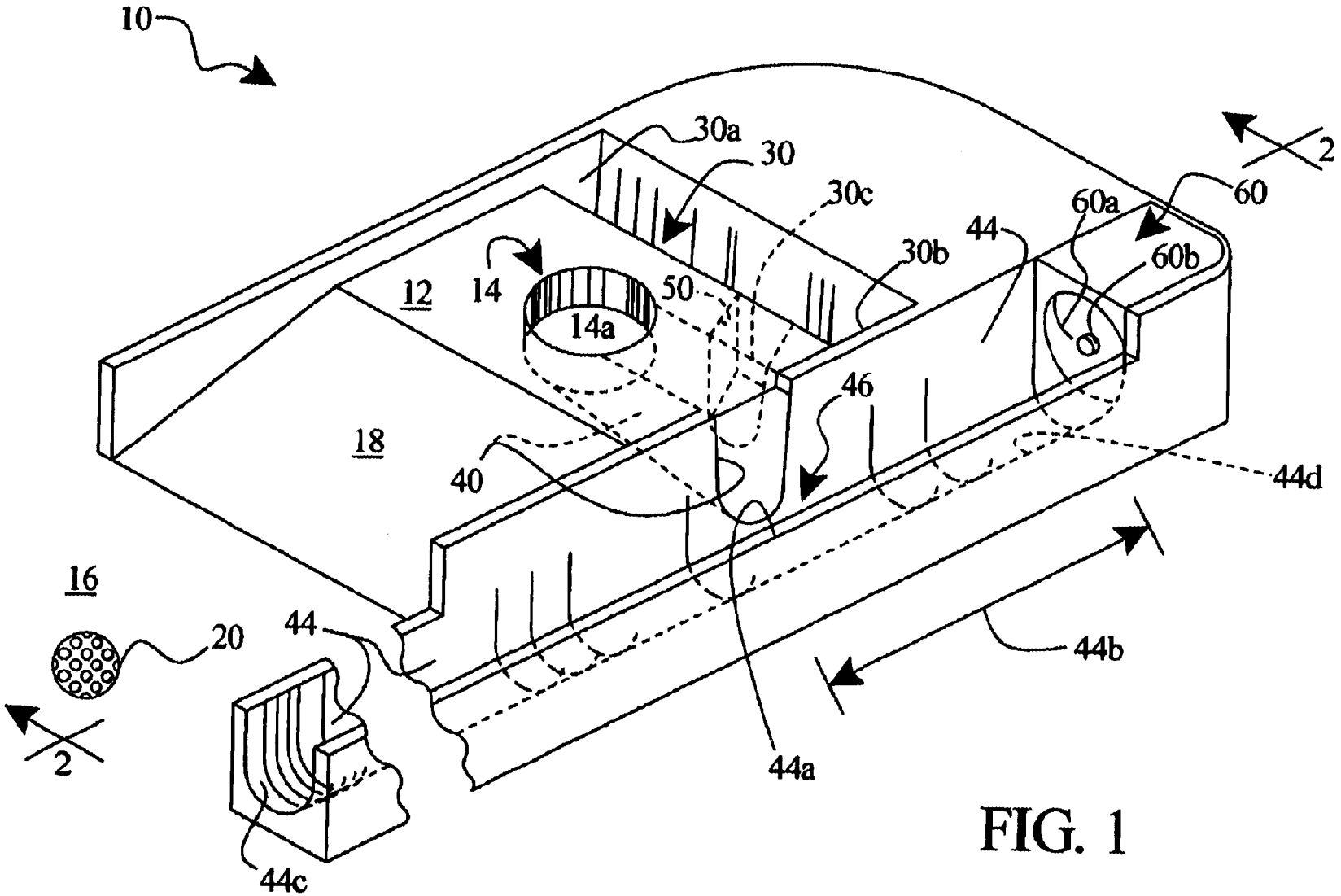
FIG. 1 illustrates in perspective a golf putting training device according to a first embodiment of the present invention.

FIG. 1 illustrates a first embodiment of the present invention, a golf putting training device 10. Device 10 includes a plateau 12 and a target hole 14. A putting area 16 lies in front of plateau 12 and a ramp 18 lies intermediate of putting area 16 and plateau 12. Putting area 16 can be the floor or carpet upon which device 10 rests or can be a mat, or other such putting surface structure, integral to device 10. In any case, a golfer places a golf ball 20 in putting area 16, strikes the golf ball 20, and attempts to drop the golf ball 20 in hole 14. If well putted, ball 20 travels along putting area 16, up ramp 18, onto plateau 12, into hole 14, and reaches well 14*a* of hole 14. Should golf ball 20 miss hole 14, however, a capture trench 30 lies across the back of plateau 12 and receives golf ball 20 therein. Each end, i.e., left end 30*a* and right end 30*b*, of capture trench 30 inclines downward and laterally inward toward a trench well 30*c*. Thus, golf ball 20 travels in trench 30 laterally inward and eventually reaches well 30*c*.

A discharge chute 40 couples well 14*a* of hole 14 to a return gutter 44. Any golf ball 20 reaching well 14*a* rolls under influence of gravity laterally along chute 40 and into return gutter 44 at ball discharge site 46. As may be appreciated, chute 40 lies under plateau 12 as a tunnel structure and does not interfere with travel of ball 20 across plateau 12. An inclined tunnel 50, also located under plateau 12, couples well 30*c* of trench 30 to chute 40, i.e. any golf ball 20 reaching well 30*c* rolls along tunnel 50, into chute 40 and eventually reaches ball discharge site 46 of return gutter 44. Thus, plateau 12, hole 14, trench 30, tunnel 50, and chute 40 serve as a ball-capture structure carrying any ball 20 reaching plateau 12 eventually to discharge site 46 of return gutter 44. Important to note, the lateral momentum of ball 20 substantially dies at discharge site 46 when ball 20 travels laterally into gutter 44 and hits side wall 44*a* thereof at site 46.

Figure 2:
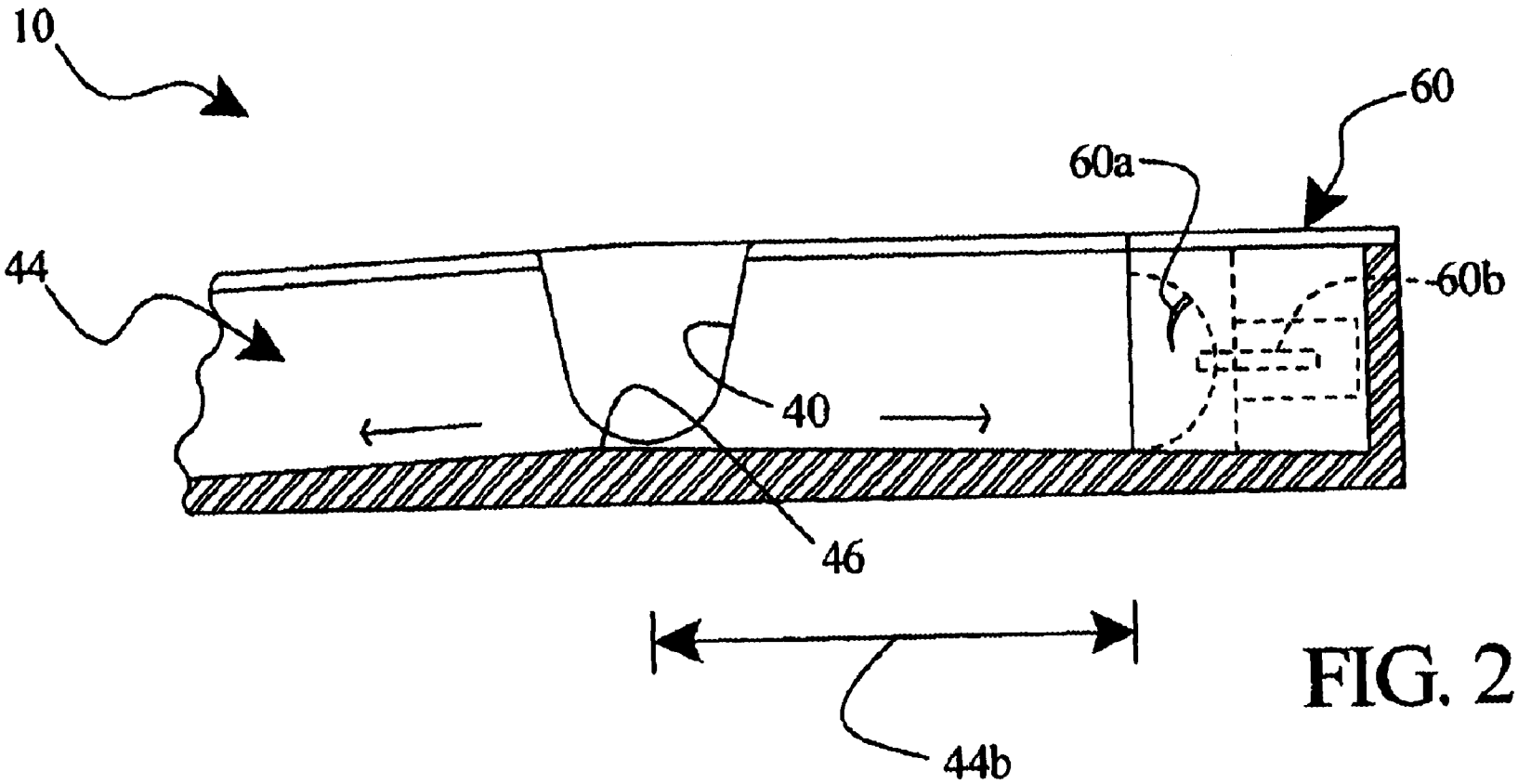
FIG. 2 illustrates in section the golf putting training device of FIG. 1 as taken along lines 2—2 of FIG. 1.

A conventional kick-back device 60 lies at the distal end of return gutter 44. As best seen in FIG. 2, return gutter 44 includes a reverse slope section 44*b* between site 46 and kick-back device 60. Section 46 slopes downward toward kick-back device 60. Device 60 includes a trigger 60*a* and a plunger 60*b*. When ball 20 engages trigger 60*a*, device 60 activates plunger 60*b* and plunger 60*b* propels ball 20 longitudinally along the length of gutter 44 back past discharge site 46 and onto a gutter outlet 44*c*. In this particular embodiment, return gutter outlet 44*c* is a simple open-ended structure with no side-kick feature. As will be shown hereafter, however, such a side-kick feature may be used if desired.

Reverse slope section 44*b* has a concave floor 44*d* guiding balls 20 along a straight path directly toward kick-back device 60. In the particular embodiment shown, floor 44*d* is curvilinear in cross-section. A variety of floor 44*d* shapes, however, would establish a consistent path of approach back toward the kick-back device 60. Thus, for example, a V-shaped floor would carry ball 20 along a consistent path back into kickback device 60, but a flat or convex floor 44*d* shape would not carry ball 20 along a consistent path back into kick-back device 60. In any case, the geometry of the concave shape of floor 44*d* is sufficient in relation to a golf ball diameter to establish a substantially straight path for a golf ball moving along section 44*b* and toward kick-back device 60.

Thus, any ball 20 reaching discharge site 46 from chute 40 loses substantially all its momentum at site 46 upon striking wall 44*a*. In use, ball 20 strikes wall 44*a* and rattles, i.e. rocks laterally in gutter 44, at site 46. At this point ball 20 has substantially no longitudinal momentum. Ball 20 then slowly begins to roll back toward kick-back device 60, i.e., develops momentum under influence of gravity along the slope of section 44*b*, and eventually reaches kick-back device 60. Golf ball 20 thereby develops new and controlled momentum down the reverse slope of section 44*c* and along the consistent path of travel provided by floor 44*d* into kick-back device 60. As should be appreciated, therefore, any ball 20 dropping into hole 14 or into trench 30 arrives at kick-back device 60 with consistent momentum and along a consistent path directly into trigger 60*a*. This allows kick-back device 60 opportunity to consistently engage ball 20 and to propel ball 20 back along return gutter 44 toward outlet 44*c* with consistent momentum. As a result, any ball 20 exiting return gutter 44, whether by direct outlet 44*c* or by a side-kick structure, more consistently comes to rest at a given location in putting area 16.

Figure 3A:
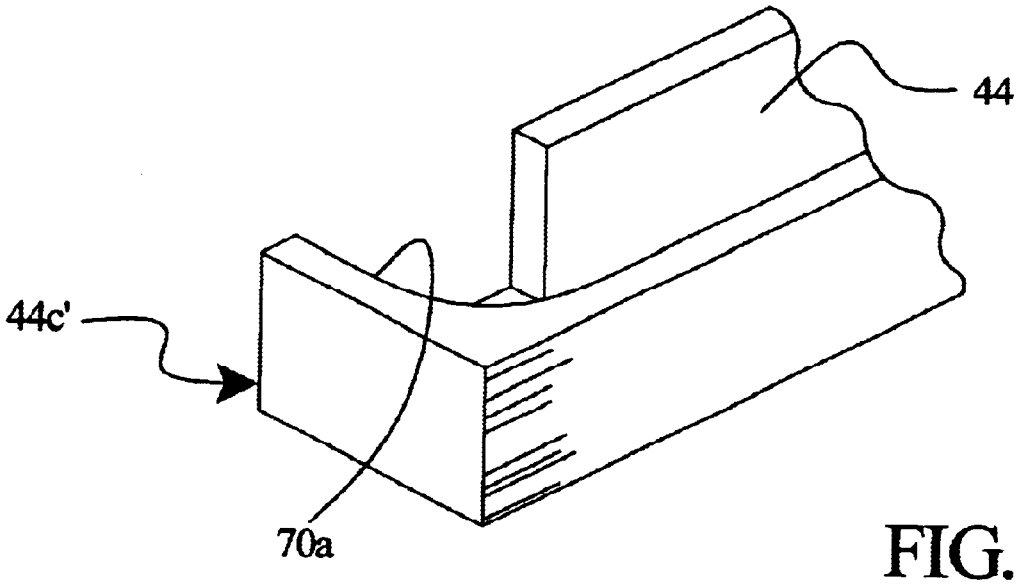
FIGS. 3A and 3B illustrate sick-kick structures as alternative embodiments of the golf putting training device of FIG. 1.
Figure 3B:
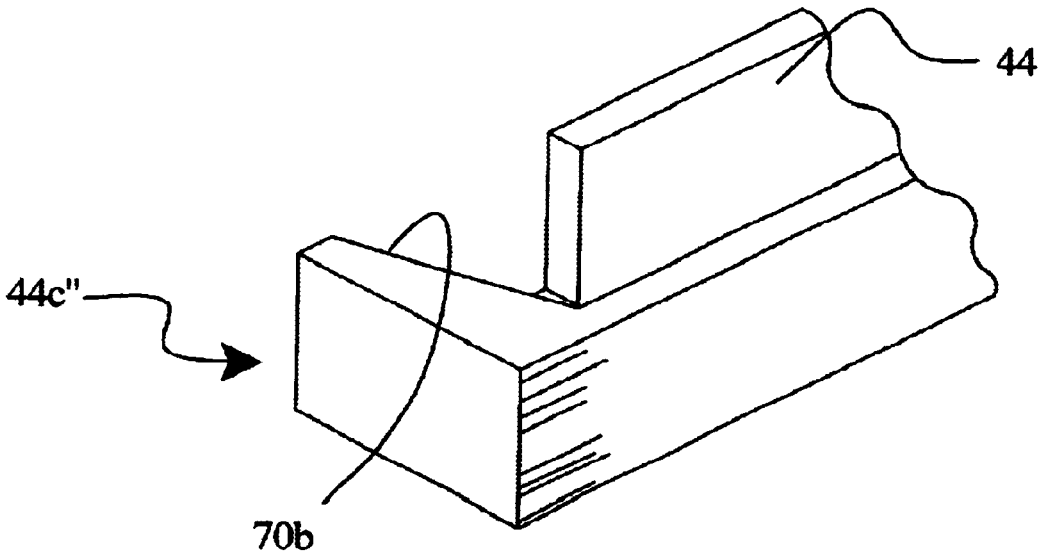
Figure 4:
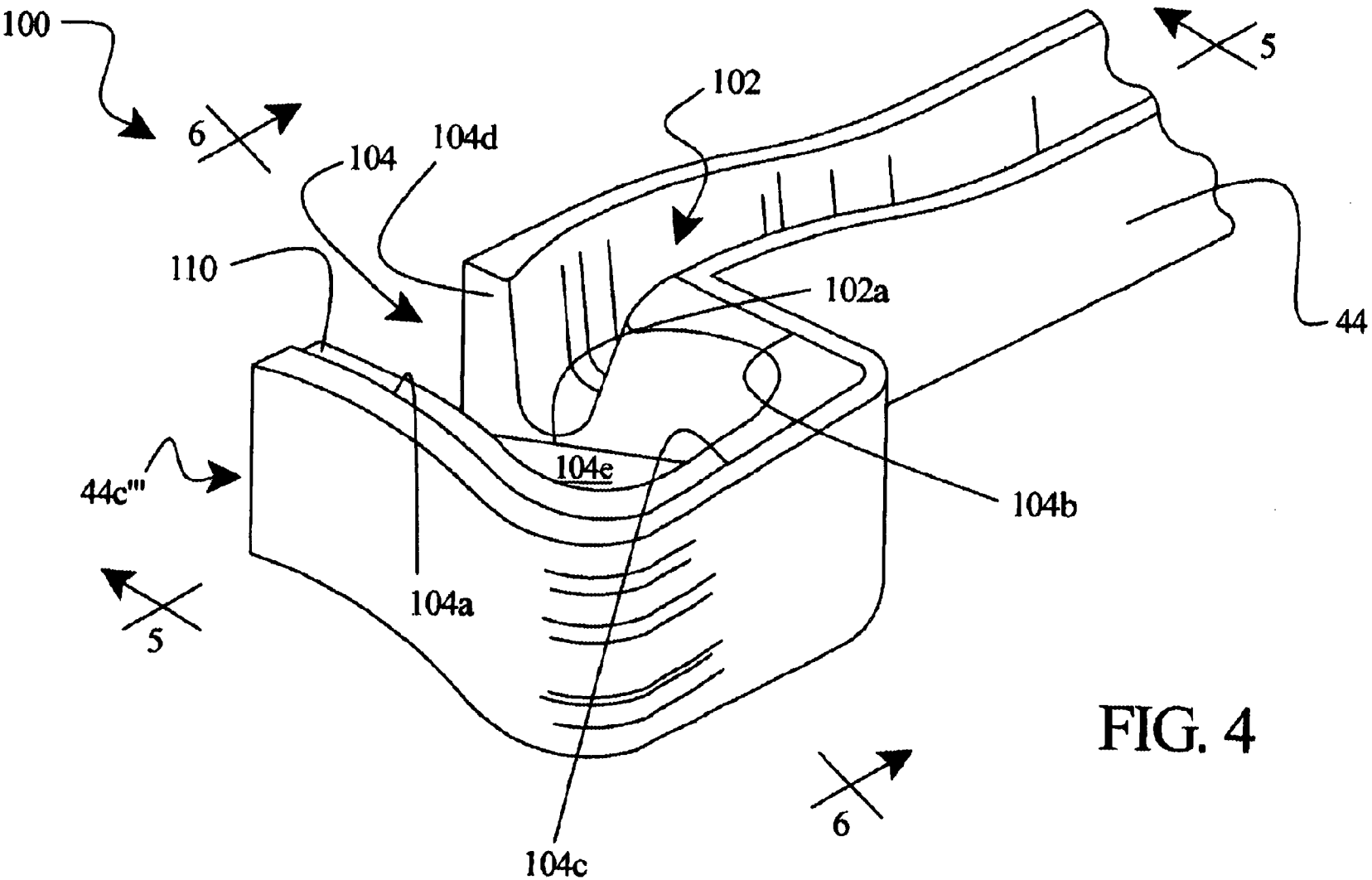
FIG. 4 illustrates in perspective a side-roll structure according to the present invention.
Figure 5:
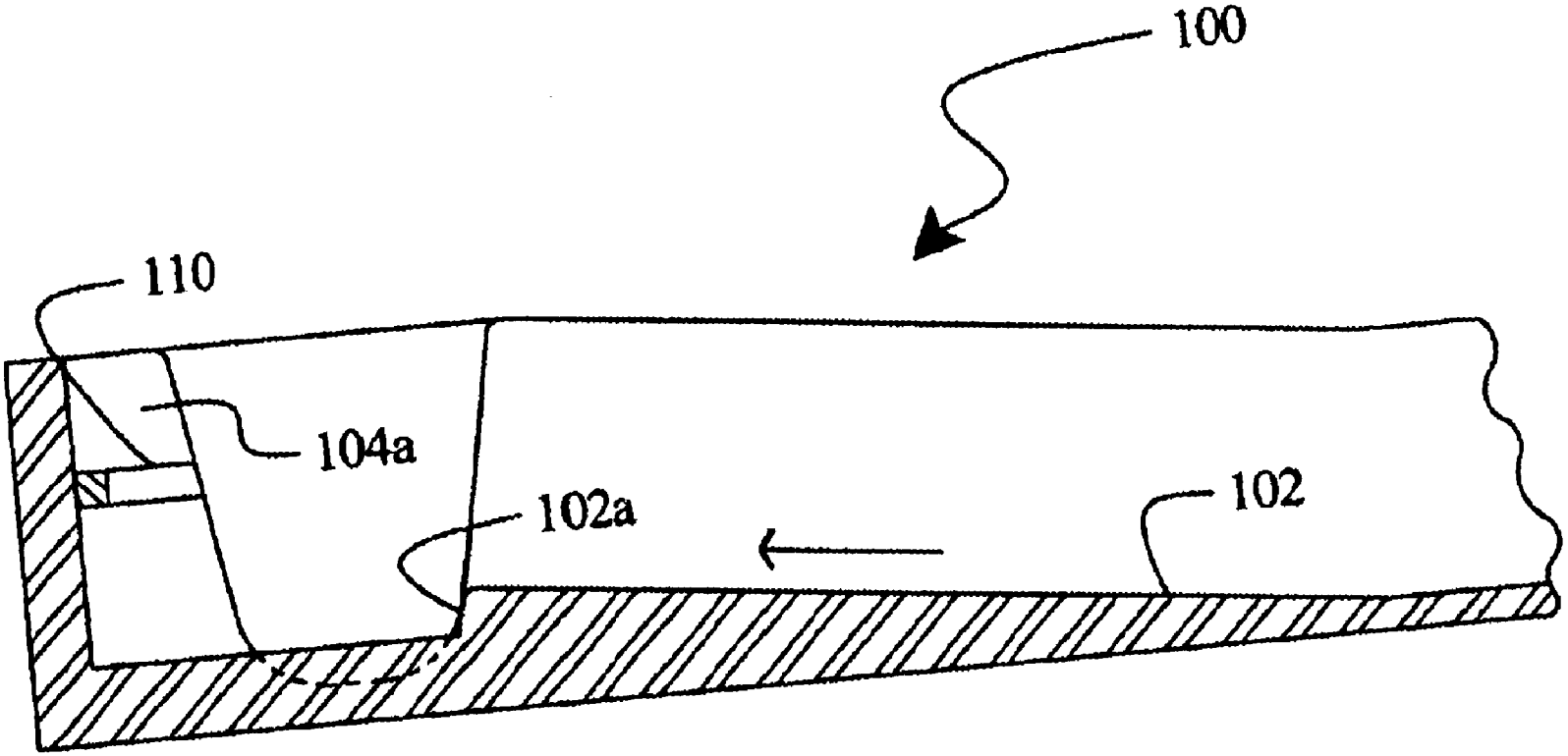
FIG. 5 illustrates in section the side-roll structure of FIG. 4 as taken along lines 5—5 of FIG. 4.
Figure 6:
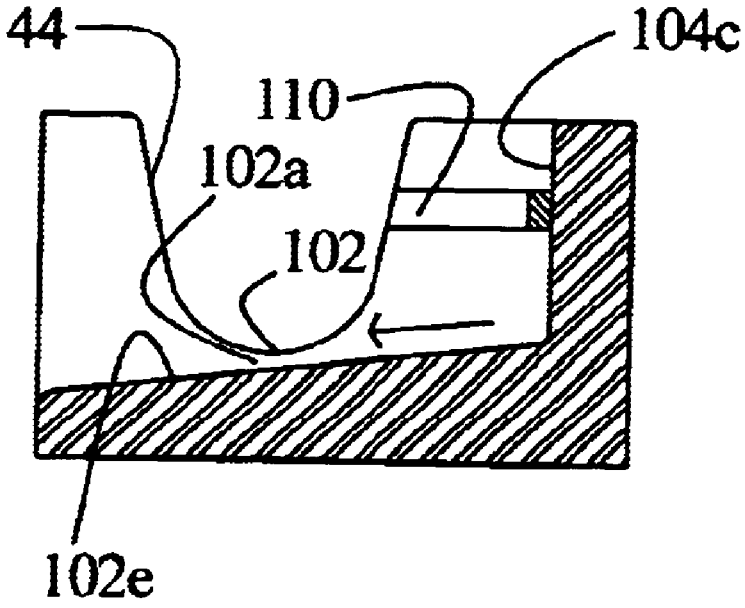
FIG. 6 illustrates in section the side-roll structure of FIG. 4 as taken along lines 6—6 of FIG. 4.
Figure 7:
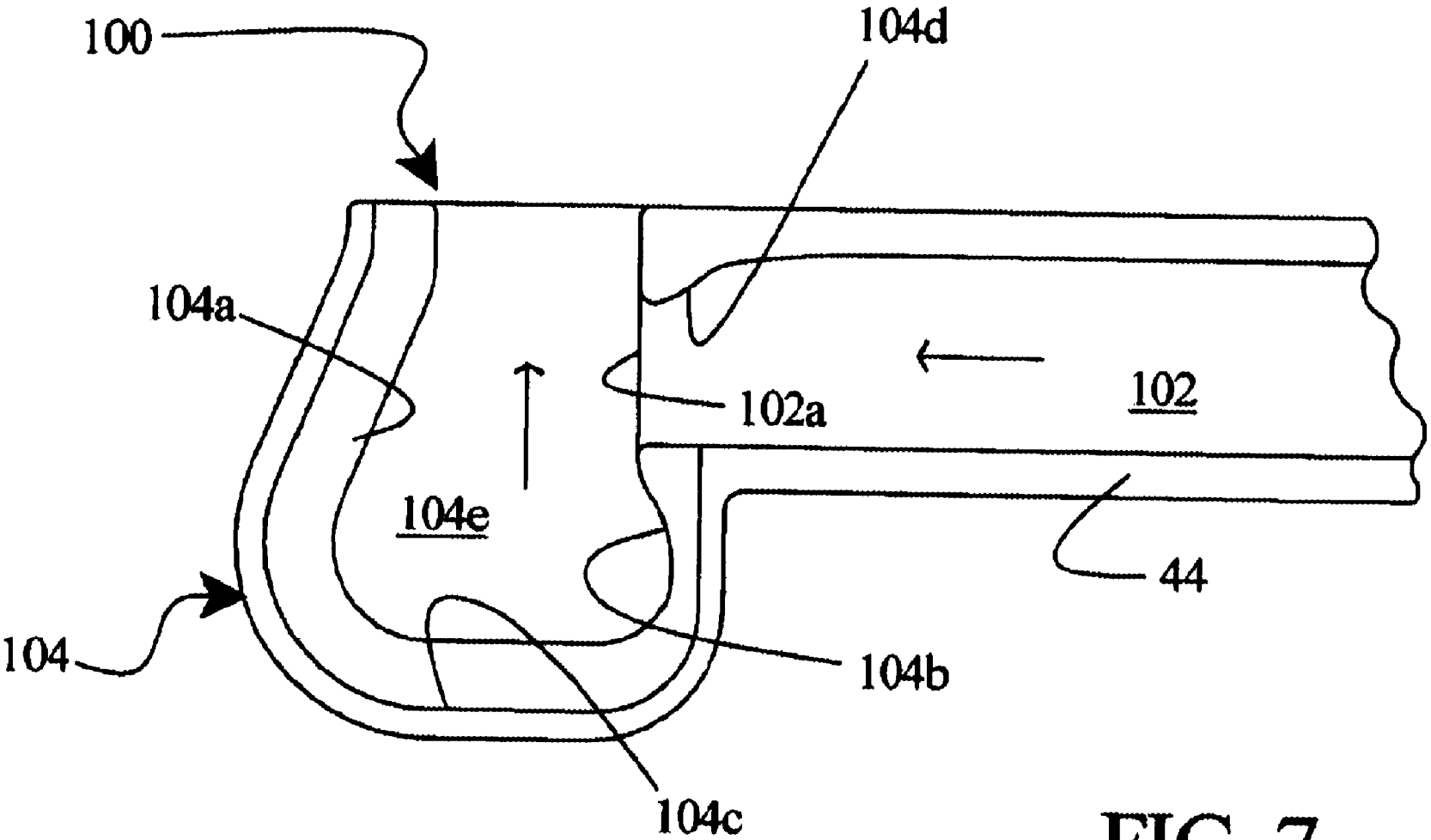
FIG. 7 is a top view of the side-roll structure of FIGS. 4–6.

FIGS. 3A and 3B illustrate side-kick structures 44*c*' and 44*c*", respectively, typical of conventional side-kick devices converting ball 20 longitudinal momentum along the gutter 44 into lateral momentum onto putting area 16. The particular geometry varies, e.g., a curved deflecting wall 70*a* (FIG. 3A) or angled flat deflecting wall 70*b* (FIG. 3B), but in each case ball 20 momentum along gutter 44 is converted by deflecting the ball laterally toward and onto putting area 16. In conventional golf putting training devices, inconsistent momentum along a return gutter results in inconsistent ball positioning in the return putting area. Under the controlled ball momentum of present invention, however, ball 20 enjoys consistent momentum along return gutter 44 and when deflected at wall 70*a* or 70*b* enjoys consistent final positioning in putting area 16. Thus, device 10 uses a variety of alternative gutter outlets or side-kick structure geometries to consistently position a ball 20 upon return to area 16. Thus, the present invention finds application with conventional side-kick structures converting by deflection longitudinal ball momentum into lateral momentum.

The present invention also finds application, however, as an alternative to conventional side-kick devices. FIGS. 4–7 illustrate a side-roll device 100 as an outlet 44*c*'" relative to golf training device 10. Generally, side-roll device 100 absorbs the longitudinal momentum of ball 20 remaining at the proximal end of gutter. Ball 20 then rolls laterally under influence of gravity on a sloped floor out onto putting area 16. Thus, ball 20 is not deflected directly back onto area 16 and, therefore, positioned inconsistently as a function of inconsistent delivery momentum as in the prior art. Rather, device 100 releases ball 20 from substantially zero momentum and under controlled conditions to roll back to a consistent position in area 16. While illustrated as an outlet 44*c*''' for use with device 10, it will be understood that side-roll device 100 may be used with conventional golf training devices, i.e., even with those imparting inconsistent momentum along the return gutter to the putting area. For example, side-roll device 100 finds application with the training device of U.S. Pat. No. 5,102,141 as a substitute for the side-kick device thereof.

In FIGS. 4–7, device 100 includes an upward sloped approach 102 as the proximal end of gutter 44. Thus, ball 20 must have sufficient momentum along the return gutter 44 to overcome the slope of approach 102, e.g., a kick-back device must impart sufficient momentum to climb approach 102 at the proximal end of gutter 44. While varieties of particular configurations are possible, a 5-degree slope for approach 102 has proven successful. Approach 102 terminates at lip 102*a*, i.e., a slight drop into a box 104. Lip 102*a* prevents ball 20 from re-entering gutter 44 and falling back down approach 102. Approach 102 delivers ball 20 into box 104. Ball 20 continues longitudinal travel across box 104 and strikes deflection wall 104*a*. Wall 104*a* lies at sufficient angle to deflect ball 20 laterally away from putting area 16 and thereby absorb a substantial portion of longitudinal momentum of ball 20.

As ball 20 continues to bounce about in box 104, substantially all of the delivery momentum, i.e., longitudinal momentum as present upon arrival at box 104, is absorbed in box 104. Thus, box 104 includes additional walls to positioned to contain and absorb the momentum of ball 20. A second deflection wall 104*b* lies opposite wall 104*a* and at such angle to deflect ball 20 away from putting area 16. Wall 104*c* couples wall 104*a* and wall 104*c* and lies along a substantially longitudinal line. A third deflection wall 104*d*, also positioned to deflect ball 20 away from putting area 16, lies at the junction between approach 102 and box 104. To further absorb the momentum of ball 20, a bumper 110, e.g., a strip of self-adhesive foam rubber, lies about the walls 104*a*–104*d* of box 104.

Again, a variety of particular geometries are possible, but in the particular example illustrated herein wall 140*a* lies at approximately 20 degrees relative to a lateral line, wall 104*b* at approximately 25 degrees relative to a lateral line, 104*c* at approximately 90 degrees to a lateral line, and wall 104*d* at approximately 15 degrees to a longitudinal line. In any case, the walls of box 104 are positioned to absorb the delivery momentum of ball 20 upon reaching box 104.

Floor 104*e* of box 104 slopes down toward putting area 16. Thus, ball 20 first loses its delivery momentum in box 104 and then generates new and controlled momentum as it rolls under influence of gravity down floor 104*e* and out and onto putting area 16. A 7-degree slope for floor 104*e* has proven successful, but variations in slope are within the scope of the present invention. In this manner ball 20 is carried a consistent distance from side-roll device 100. Providing a concave shape for floor 104*e* would also direct ball 20 along a consistent path out of box 104 and onto area 16. However, a flat shape of floor 140*e* has proven successful. Thus, while a concave floor 44*d* is important to direct ball 20 consistently along a given path into kick-back device 60 for consistent return momentum, side-roll device 100 can make use of a flat floor 104*e* and still acceptably, i.e. sufficiently consistently, return ball 20 to putting area 16.

Figure 8:
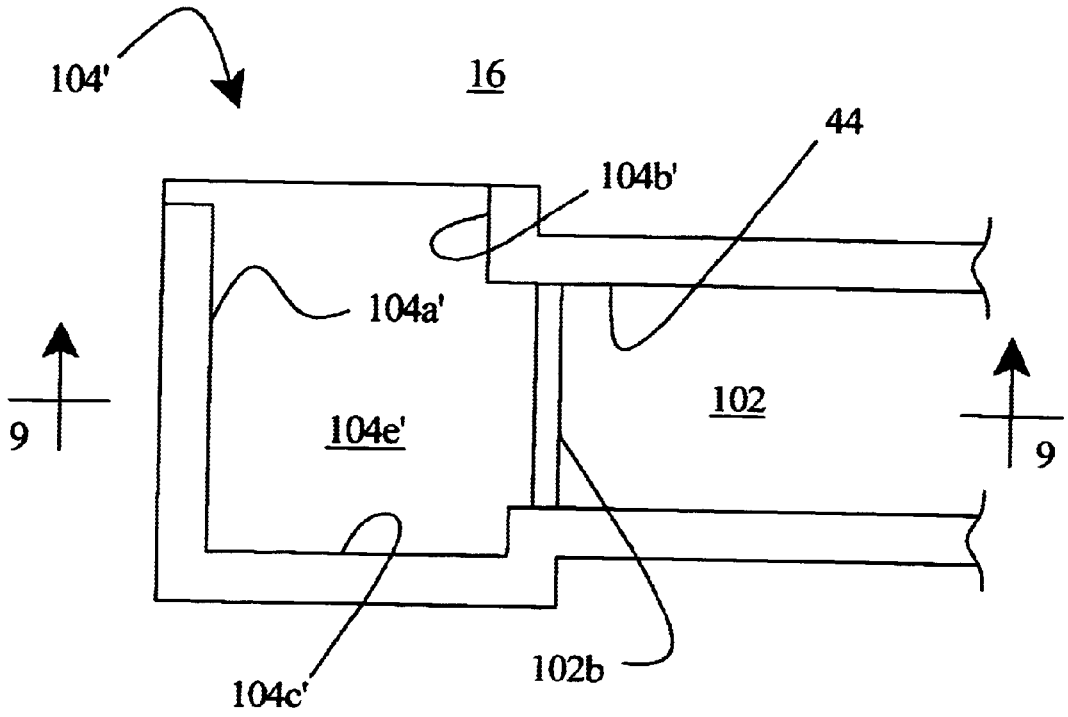
FIG. 8 illustrates in top view an alternative side-roll device according to an alternative embodiment of the present invention.
Figure 9:
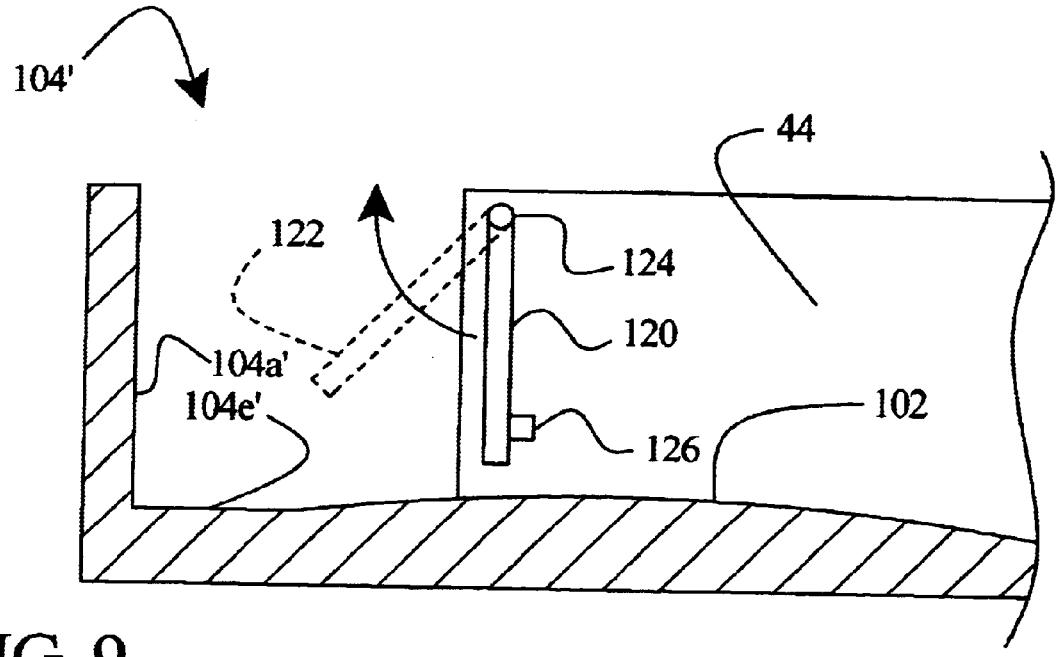
FIG. 9 illustrates the side-roll device of FIG. 8 in section as taken along lines 9—9 of FIG. 8.

In the alternative, a one-way gate, e.g. flap structure, serves a similar purpose as lip 102. For example, in FIGS. 8 and 9 a modified box 104' is shown with a one-way gate 102*a*' replacing lip 102*a* as a mechanism to prevent ball 20 from re-entering gutter 44 and rolling down approach 102. In this particular example of the present invention, wall 104*a*' lies normal to the longitudinal path of ball 20 as ball 20 enters box 104'. Gate 102*a*' comprises a flap panel 120 pivoting as indicated at reference numeral 122 about axis 124 and allowing ball 20 to pass from gutter 44 into box 104'. A stop 126 prevents, however, panel 120 from pivoting back past a vertical position and into gutter 44. Panel 102*a*' thereby presents an obstacle to a ball bouncing off wall 104*a*' of box 104'. Thus, a ball 20 entering gate 102*a*' cannot thereafter re-enter gutter 44 and roll back down approach 102. In this particular embodiment, walls 104*a*', 104*b*', 104*c*' and 104*d* of box 104' are generally rectangular. As with box 104, floor 104*e*' slopes downward toward putting area 16. A ball entering box 104' passes through gate 102*a*' and strikes wall 104*a*' losing most of its longitudinal momentum as it bounces between wall 104*a*' and panel 102*a*'. Eventually, ball 20 loses all its longitudinal momentum and rolls down floor 104*e*' and out onto putting area 16 with controlled, i.e., consistent, momentum and final resting position.

It will be appreciated that the present invention is not restricted to the particular embodiment that has been described and illustrated, and that variations may be made therein without departing from the scope of the invention as found in the appended claims and equivalents thereof.

What is claimed is:

1. A golf ball return system relative to a putting surface having a proximal end and a distal end and having a puffing area at the proximal end of the putting surface, said system comprising:

a ball capture area at the distal end of the putting surface, said ball capture area including at least one of a cup and a capture trench, said ball capture area including a ball capture discharge chute communicating with said at least one of said cup and said capture trench to carry a golf ball from said at least one of said cup and said capture trench to said ball capture discharge chute;

a kick-back device including a trigger and a plunger, said plunger being activated in response to engagement of said trigger; and a return gutter having at a distal end thereof said kick-back device and having at a proximal end thereof a return gutter discharge, said return gutter communicating with said ball capture discharge chute at a ball discharge receive site therealong and spaced from said distal end of said return gutter, said return gutter being sloped downward along a reverse slope section thereof from said ball discharge receive site to said kick-back device, said return gutter having a concave floor at least along said reverse slope section, said return gutter discharge including a side-roll structure comprising an entry accepting the ball from said gutter along a longitudinal path, a wall structure opposite said entry and engaging the ball, said wall being in such angular orientation relative to said longitudinal path to divert the ball in a first lateral direction, and a floor carrying the ball and sloped in a second lateral direction toward a side-roll discharge.

2. A side-roll structure for a golf putting training device including a kick-back plunger propelling a golf ball along a return gutter, the side-roll device adapted for use with the golf putting training device comprising:

an entry accepting the ball from the gutter along a longitudinal path;

a wall structure opposite said entry and adapted to engage the ball, said wall structure being in such angular orientation relative to said longitudinal path to divert the ball in a first lateral direction; and a floor for carrying the ball and sloped in a second lateral direction toward a side-roll discharge.

3. A side-roll structure according to claim 2 wherein said first lateral direction is away from side-roll discharge.

4. A golf ball return system relative to a putting surface having a proximal end and a distal end and having a putting area at the proximal end of the putting surface, said system comprising:

a ball capture area at the distal end of the putting surface, said ball capture area including at least one of a cup and a capture trench, said ball capture area including a ball capture discharge chute communicating with said at least one of said cup and said capture trench to carry a golf ball from said at least one of said cup and said capture trench to said ball capture discharge chute;

a kick-back device including a trigger and a plunger, said plunger being activated in response to engagement of said trigger; and a return gutter having at a distal end thereof said kick-back device and having at a proximal end thereof a return gutter discharge, said return gutter communicating with said ball capture discharge chute at a ball discharge receive site therealong and spaced from said distal end of said return gutter, said return gutter being sloped downward along a reverse slope section thereof from said ball discharge receive site to said kick-back device, said return gutter having a concave floor at least along said reverse slope section, said return gutter discharge comprising a side-roll structure, said side-roll structure comprising:

a one-way entry accepting the ball from said gutter along a longitudinal path and preventing re-entry of the ball back into said gutter;

a wall structure opposite said entry and engaging the ball; and a floor carrying the ball and sloped in a direction toward a side-roll discharge.

5. A golf ball return system according to claim 4 wherein said one-way entry comprises a hinged panel pivoting in response to the ball in a first direction and blocking the ball in an opposite direction.

6. A side-roll structure adapted for use with a golf putting training device including a kick-back plunger propelling a golf ball along a return gutter, the side-roll structure comprising:

a one-way entry accepting the ball from the gutter along a longitudinal path;

a wall structure opposite said entry and adapted to engage the ball to absorb longitudinal momentum thereof; and a floor for carrying the ball and sloped in a lateral direction toward a side-roll discharge.

7. A side-roll structure according to claim 6 wherein said one-way entry comprises a hinged panel.

* * * * *